US008834234B2

(12) United States Patent
Ueno et al.

(10) Patent No.: US 8,834,234 B2
(45) Date of Patent: Sep. 16, 2014

(54) DOUBLE-SIDE POLISHING APPARATUS

(75) Inventors: Junichi Ueno, Nishishirakawa (JP); Kazuya Sato, Nishishirakawa (JP); Syuichi Kobayashi, Nishishirakawa (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 211 days.

(21) Appl. No.: 13/509,696

(22) PCT Filed: Nov. 16, 2010

(86) PCT No.: PCT/JP2010/006711

§ 371 (c)(1),
(2), (4) Date: May 14, 2012

(87) PCT Pub. No.: WO2011/077631

PCT Pub. Date: Jun. 30, 2011

(65) Prior Publication Data

US 2012/0329373 A1 Dec. 27, 2012

(30) Foreign Application Priority Data

Dec. 24, 2009 (JP) ..... 2009-291825

(51) Int. Cl.
*B24B 37/013* (2012.01)
*B24B 37/08* (2012.01)

(52) U.S. Cl.
CPC ..... *B24B 37/013* (2013.01); *B24B 37/08* (2013.01)
USPC ..... 451/262; 451/6; 451/7; 451/53

(58) Field of Classification Search
CPC .... B24B 49/105; B24B 53/095; B24B 55/02; G01B 21/08; G01B 2210/56; H01L 22/30; G01L 3/10
USPC ..... 451/6, 7, 26, 53, 449, 488; 73/866.5, 73/865.8
See application file for complete search history.

(56) References Cited

U.S. PATENT DOCUMENTS 3,571,978 A * 3/1971 Day et al. ..... 451/288
3,823,515 A * 7/1974 Coes, Jr. ..... 451/53

(Continued)

FOREIGN PATENT DOCUMENTS

JP A-10-202514 8/1998
JP A-2000-6018 1/2000

(Continued)

OTHER PUBLICATIONS

English-translation of International Preliminary Report on Patentability issued in International Application No. PCT/JP2010/006711 dated Jul. 4, 2012.

(Continued)

*Primary Examiner* — George Nguyen
(74) *Attorney, Agent, or Firm* — Oliff PLC

(57) ABSTRACT

A double-side polishing apparatus including at least: upper and lower turn tables each having a polishing pad attached thereto; a carrier having a holding hole formed therein for holding a wafer between the upper and lower turn tables; a sensor for detecting a thickness of the wafer during polishing, the sensor being disposed in a through-hole provided at the upper turn table in a direction of an upper-turn-table rotation axis; and a sensor holder for holding the sensor, wherein a material of the sensor holder is quartz. As a result, there is provided a double-side polishing apparatus that can polish a wafer while the difference from the target wafer thickness is reduced by surely inhibiting deformation of the sensor holder due to the influence of heat generated during the polishing of the wafer.

8 Claims, 3 Drawing Sheets

(56) References Cited

U.S. PATENT DOCUMENTS

| | | | | |
|---|---|---|---|---|
| 3,916,573 | A * | 11/1975 | Elbe | 451/7 |
| 4,705,016 | A * | 11/1987 | Sekiya | 125/13.01 |
| 4,791,759 | A * | 12/1988 | Komata | 451/5 |
| 5,433,651 | A * | 7/1995 | Lustig et al. | 451/6 |
| 5,605,487 | A * | 2/1997 | Hileman et al. | 451/5 |
| 5,803,798 | A * | 9/1998 | Cesna et al. | 451/269 |
| 6,402,589 | B1 | 6/2002 | Inaba et al. | |
| 6,476,921 | B1 * | 11/2002 | Saka et al. | 356/630 |
| 6,687,643 | B1 * | 2/2004 | Cason, Jr. | 702/137 |
| 6,796,879 | B2 * | 9/2004 | Cheng et al. | 451/6 |
| 7,147,541 | B2 * | 12/2006 | Nagayama et al. | 451/5 |
| 7,281,441 | B2 * | 10/2007 | Lee | 73/865.8 |
| 7,347,770 | B2 * | 3/2008 | Ohkura | 451/262 |
| 7,418,185 | B2 * | 8/2008 | Lee | 385/137 |
| 7,536,900 | B2 * | 5/2009 | Nakamura et al. | 73/49.2 |
| 8,137,574 | B2 * | 3/2012 | Otsuka et al. | 216/38 |
| 8,342,019 | B2 * | 1/2013 | Hokamura | 73/431 |
| 2003/0143403 | A1 * | 7/2003 | Shibano et al. | 428/410 |
| 2006/0110086 | A1 * | 5/2006 | Morita et al. | 384/448 |
| 2006/0185451 | A1 * | 8/2006 | Han et al. | 73/866.5 |
| 2006/0204199 | A1 * | 9/2006 | Lee | 385/137 |
| 2007/0161334 | A1 * | 7/2007 | Ohkura | 451/11 |
| 2008/0085658 | A1 * | 4/2008 | Katsuoka et al. | 451/7 |
| 2008/0202207 | A1 * | 8/2008 | Moore | 73/23.31 |
| 2010/0300175 | A1 * | 12/2010 | Hokamura | 73/1.06 |
| 2011/0051200 | A1 * | 3/2011 | Iwasaki et al. | 358/474 |

FOREIGN PATENT DOCUMENTS

| | | |
|---|---|---|
| JP | A-20004-117626 | 4/2000 |
| JP | A-2007-54925 | 3/2007 |
| TW | 411299 | 10/1988 |

OTHER PUBLICATIONS

Apr. 24, 2012 Office Action issued in Japanese Patent Application No. 2009-291825 (with partial translation).

Feb. 1, 2011 International Search Report issued in International Patent Application No. PCT/JP2010/006711.

Apr. 15, 2014 Office Action issued in Taiwanese Application No. 099141253 (w/ partial English Translation).

* cited by examiner

RELATED ART (A)

DOUBLE-SIDE POLISHING APPARATUS

TECHNICAL FIELD

The present invention relates to a double-side polishing apparatus, and more specifically to a double-side polishing apparatus that can stop polishing when the thickness of a wafer has reached a target thickness in a double-side polishing process of wafer manufacture.

BACKGROUND ART

In order to stably manufacture high flatness semiconductor wafers, it is necessary to polish semiconductor wafers so as to have a target final thickness.

In conventional polishing methods, the polishing time of a current polishing batch is calculated on the basis of a polishing speed in a previous polishing batch, e.g. in the start of operation, to finish a wafer with a target thickness.

In this method, however, changes of a polishing state, e.g. due to the wear of a carrier, a polishing pad, and a polishing slurry cause a difference between an actual polishing rate and a calculated polishing rate. This makes it difficult to obtain the target final thickness in every batch.

Such a deviation of a final thickness from the target final thickness in polishing is one of reasons for deterioration of flatness.

It is therefore necessary to polish the semiconductor wafer while the final thickness of the wafer is detected. A device for measuring a thickness is called as a sizing device.

As examples of the sizing device, there exist an optical-type device that directly measures the wafer thickness, an eddy-current-type device, an electrostatic-capacity-type device, and a device having a crystal plate that measures the wafer thickness by resonance, i.e. a transit method-type device (e.g. See Patent Document 1).

For example, when the thickness is measured with a sensor of the type that has a narrow measuring range, such as the eddy-current sensor and the electrostatic capacity sensor, the sensor needs to approach the wafer in measurement. In a conventional double-side polishing apparatus as shown in FIG. 3, accordingly, a through-hole 108 is provided at an upper turn table 102 in the direction of an upper-turn-table rotation axis, and the sensor is disposed near the lower end in the through-hole 108 of the upper turn table 102, i.e. at a position near the wafer.

In this case, a sensor holder 107 is needed and the sensor 106 is held at the end (the lower end) of the sensor holder 107.

For example, the sensor holder 107 is slightly smaller than the through-hole 108 provided at the upper turn table 102 so as not to make direct contact with the upper turn table 102. The sensor holder 107 is fixed at the upper portion of the upper turn table. The sensor 106 is fixed so as to locate at approximately 500 μm away from a polishing pad 104. The interior of the sensor holder 107 is hollowed to reduce heat conduction. The sensor holder is made of metal material such as super invar, and hung from the upper surface of the upper turn table 102 to be attached.

Double-side polishing of the wafer is performed while the wafer thickness is measured by using the sensor held with the sensor holder to finish the wafer with the target thickness.

CITATION LIST

Patent Literature

Patent Document 1: Japanese Unexamined Patent publication (Kokai) No. H10-202514

SUMMARY OF INVENTION

However, even when the double-side polishing of the wafer is performed with the conventional double-side polishing apparatus having such a sensor, a difference between the target thickness and the actual thickness of the polished wafer cannot be reduced to within a target range, for example 1 μm or less. There is therefore a need for further improvement of polishing precision.

In view of this, the present inventors investigated the cause for the inability to reduce the difference. As a result, the present inventors found that regardless of the above countermeasure against thermal expansion for the sensor holder, heat generated during polishing is transferred from the upper turn table to the sensor holder, the sensor holder is expanded and contracted, and a deviation of a sensor position occurs. This is a major cause for the difference.

The present invention was accomplished in view of the above-described problem, and its object is to provide a double-side polishing apparatus that can polish a wafer while the difference from the target wafer thickness is reduced by surely inhibiting deformation of the sensor holder due to the influence of heat generated during the polishing of the wafer.

To achieve this object, the present invention provides a double-side polishing apparatus comprising at least: upper and lower turn tables to which polishing pads are attached; a carrier having a holding hole formed therein for holding a wafer between the upper and lower turn tables; a sensor for detecting a thickness of the wafer during polishing, the sensor being disposed in a through-hole provided at the upper turn table in a direction of an upper-turn-table rotation axis; and a sensor holder for holding the sensor, wherein a material of the sensor holder is quartz.

When the material of the sensor holder is quartz, the expansion and contraction of the sensor holder due to the heat generated during polishing can be surely inhibited, and thereby the deviation of the sensor position can be surely reduced. As a result, the thickness of the wafer can be detected accurately, and the difference from the target wafer thickness can be reduced.

In the double-side polishing apparatus, the quartz preferably has a linear expansion coefficient of $5.4\times10^{-7}$/K or less.

When the quartz has a linear expansion coefficient of $5.4\times10^{-7}$/K or less, the expansion and contraction of the sensor holder due to the heat generated during polishing can be more surely inhibited.

Moreover, the sensor holder is preferably capable of being cooled using water.

When the sensor holder is capable of being cooled using water, thermal variations of the sensor holder can be inhibited so that the expansion and contraction of the sensor holder due to the heat generated during polishing can be more effectively inhibited.

Moreover, the sensor holder may have a cylindrical body accommodated in the through-hole of the upper turn table, hold the sensor at a position of a lowermost end of the cylindrical body, and have an inlet for introducing a coolant into the interior of the cylindrical body and an outlet for discharging the coolant.

When the sensor holder has the cylindrical body accommodated in the through-hole of the upper turn table, holds the sensor at a position of the lowermost end of the cylindrical body, and has the inlet for introducing a coolant into the interior of the cylindrical body and the outlet for discharging the coolant, the sensor holder can be cooled with a simple structure, and the sensor is disposed nearer the wafer with the sensor holder so that the wafer thickness can be more accurately detected.

In the double-side polishing apparatus of the present invention, the material of the sensor holder for holding the sensor that detects the wafer thickness is quartz so that the expansion and contraction of the sensor holder due to the heat generated during polishing can be surely inhibited, and thereby the deviation of the sensor position can be surely reduced. As a result, the thickness of the wafer can be detected accurately, and the difference from the target wafer thickness can be reduced.

DESCRIPTION OF EMBODIMENTS

Hereinafter, embodiments of the present invention will be described, but the present invention is not limited to these embodiments.

In recent years, in order to stably manufacture a high flatness semiconductor wafer, "sizing polish" is performed in which a semiconductor wafer is polished while the wafer final thickness is detected.

The wafer final thickness is detected in such a manner that the sensor held with the sensor holder is disposed at a position near the wafer in the through-hole provided at the upper turn table in the direction of an upper-turn-table rotation axis and the double-side polishing of the wafer is performed while the wafer thickness is detected by the sensor to finish the wafer with the target thickness.

However, even when the double-side polishing of a wafer is performed with the conventional double-side polishing apparatus having such a sensor, the difference between the target thickness and the actual thickness of the polished wafer may fall outside a target range in some cases. There is therefore a need for further improvement of polishing precision.

In view of this, the present inventors repeatedly and keenly conducted studies to solve the problem. The investigation by the present inventors revealed the following: heat generated during polishing is transferred from the upper turn table to the sensor holder; the deviation of the sensor position is caused by the expansion and contraction of the sensor holder so that detection signals of the sensor contain noise due to variations in sensor's reference position; and this is a major cause for the difference.

The present inventors also found that an inhibition effect on the deformation of the sensor holder due to the heat generated during polishing can be improved by using quartz as the material of the sensor holder and consequently the deviation of the sensor position can be surely reduced, thereby bringing the present invention to completion.

Figure 1:
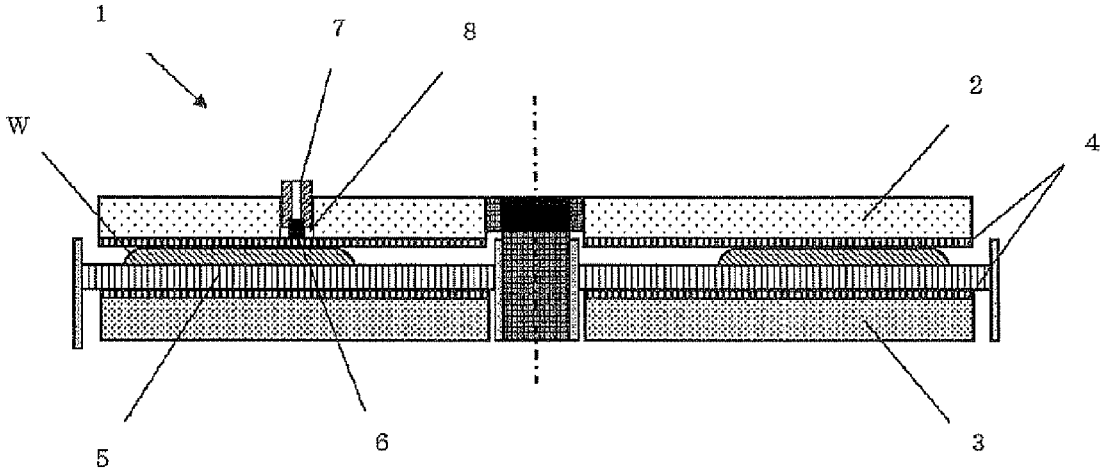
FIG. 1 is a schematic view showing an exemplary double-side polishing apparatus of the present invention.

FIG. 1 is a schematic view showing an exemplary double-side polishing apparatus of the present invention.

As shown in FIG. 1, the double-side polishing apparatus 1 of the present invention includes at least the upper turn table 2 and lower turn table 3 to which the polishing pads 4 are attached, and the carrier 5 having holding holes (not shown) formed therein for holding the semiconductor wafer W between the upper turn table 2 and lower turn table 3.

The through-hole 8 is provided at the upper turn table 2 in the direction of an upper-turn-table rotation axis. The sensor 6 for detecting the thickness of the wafer W during polishing is disposed in the through-hole 8.

A cooling passage (not shown) through which a coolant circulates may be provided to water-cool the upper turn table 2 and lower turn table 3 during polishing.

A sensor that can accurately detect the thickness of the wafer W without contact, such as an eddy-current sensor or an electrostatic capacity sensor, is desirable as the sensor 6.

The sensor 6 is held with the sensor holder 7 and disposed near the wafer W. For example, the sensor 6 can be disposed so as to locate at approximately 500 μm away from the polishing pad 4. The material of the sensor holder 7 is quartz.

In the double-side polishing apparatus 1 of the present invention, since the material of the sensor holder 7 is quartz, the linear expansion coefficient of the sensor holder is very low, the expansion and contraction of the sensor holder 7 due to the heat generated during polishing can be surely inhibited, and thereby the position deviation of the sensor 6 can be surely reduced. The double-side polishing apparatus can therefore accurately detect the thickness of the wafer W and accurately finish the wafer with the target thickness.

Particularly, the quartz preferably has a linear expansion coefficient of $5.4\times10^{-7}$/K or less.

It is more preferable that the sensor holder 7 can be cooled using water.

When the sensor holder 7 can be cooled using water, thermal variations of the sensor holder 7 itself can be inhibited while the deformation of the sensor holder 7 is avoided by using a very low linear expansion coefficient material as described above. The expansion and contraction of the sensor holder 7 due to the heat generated during the polishing of the wafer can be therefore inhibited more effectively.

Figure 2:
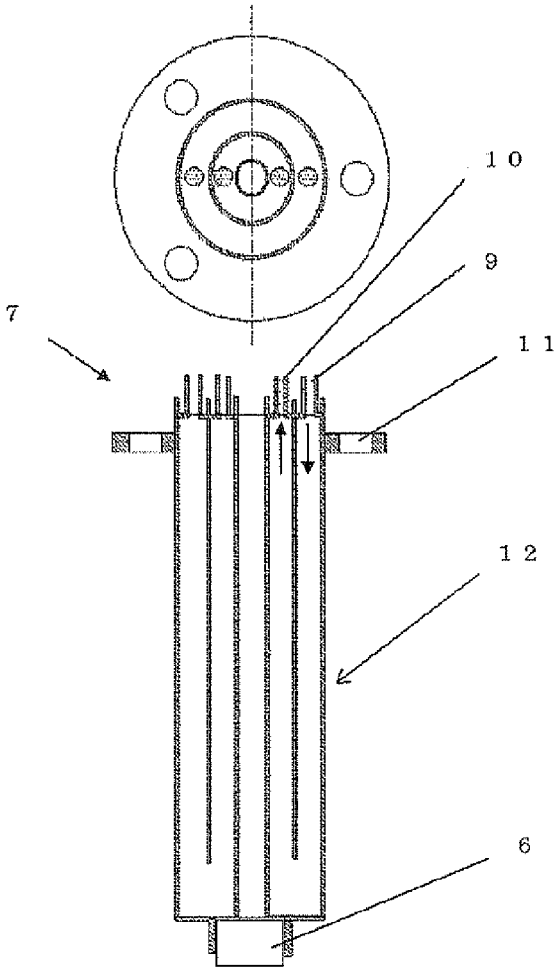
FIG. 2 is a schematic view showing an exemplary sensor holder in the double-side polishing apparatus of the present invention.

FIG. 2 is a schematic view showing an exemplary sensor holder in the double-side polishing apparatus of the present invention.

As shown in FIG. 2, the sensor holder 7 has a cylindrical body, and its size is not limited in particular. For example, the sensor holder 7 may have an inner diameter of such a degree that the sensor holder does not contact the through-hole 8 of the upper turn table 2 as shown in FIG. 1. Such a sensor holder is preferably used because the sensor holder 7 having the cylindrical body enables the cooling effect to be enhanced, and the sensor holder 7 that does not contact the through-hole 8 of the upper turn table 2 makes it difficult to transfer the heat generated during polishing from the upper turn table 2 to the sensor holder 7.

The body 12 of the sensor holder 7 is accommodated in the through-hole 8 of the upper turn table 2. In this case, the sensor holder 7 is fixed at the upper turn table 2, but the fixing method is not limited in particular. For example, as shown in FIG. 2, the sensor holder may be fixed at the upper turn table 2 by inserting a screw through a screw hole 11.

The sensor 6 is held at the lowermost end of the sensor holder 7 by being fixed with a screw and the like. When the sensor 6 is held with the sensor holder 7 in the above-described way, the sensor 6 can be disposed nearer the wafer, and the wafer thickness can be accurately detected.

As shown in FIG. 2, the sensor holder 7 has the inlet 9 for introducing a coolant into the interior of the cylindrical body and the outlet 10 for discharging the coolant. The interior of the cylindrical body has a double structure including passages through which a coolant can circulate. The sensor holder can be thus cooled with a simple structure.

Depending on the size of the sensor holder 7 and so on, the amount of the coolant introduced into the sensor holder 7 may be approximately 0.1 L/min, for example.

The double-side polishing apparatus may be configured such that a coolant branched from the above-described cooling passage for cooling the turn tables can be introduced from the inlet 9 of the sensor holder 7. This preferable configuration can realize reduction in temperature differences between the upper turn table 2 and the sensor holder 7 and inhabitation of temperature variations of the sensor holder 7.

The double-side polishing apparatus may also include a termination detecting mechanism for detecting polishing stock removal of the wafer W on the basis of detection values of the wafer W thickness from the sensor 6 and a control mechanism that automatically stop polishing according to the detection by the termination detecting mechanism.

In the double-side polishing of the wafer W with the double-side polishing apparatus of the present invention, the wafer W is interposed between the upper and lower turn tables 2 and 3 and held in the holding hole of the carrier 5, and both surfaces of the wafer W are simultaneously polished by the upper and lower polishing pads 4 while a polishing slurry is supplied through a nozzle (not shown). During the polishing, the thickness of the wafer W is detected by the sensor 6 provided at the upper turn table 2.

The present inventors conducted the following experiment to evaluate the deformation of the sensor holder 7 of the double-side polishing apparatus of the present invention due to polish-processing heat.

A hole was bored in the polishing pad 4 at the position just below the through-hole 8 provided at the upper turn table 2 in the double-side polishing apparatus 1 of the present invention as shown in FIG. 1 such that the bored hole became slightly larger than the inner diameter of the through-hole 8. A metal plate having a diameter of 35 mm and a thickness of 1 mm was adhered on the bored hole by a double-stick tape. A sensor was placed in the through-hole 8 to measure a distance to the metal plate. A wafer was then double-side polished while the distance was measured.

In this experiment, variations in the distance to the metal plate were evaluated in two cases. In one of the cases, the distance was measured by the sensor held with the quartz sensor holder (a linear expansion coefficient of $5.4\times10^{-7}$/K) in the double-side polishing apparatus of the present invention as shown in FIG. 2. In the other case, the distance was measured by the sensor held with a super invar sensor holder (a linear expansion coefficient of $1.0\times10^{-6}$/K) in the conventional double-side polishing apparatus shown in FIG. 3.

Here, polishing conditions were as follows:

Wafer: a diameter of 300 mm, P-type, a crystal orientation of <110>

Polishing Pad: single urethane foam pads

Polishing Slurry:NaOH-based colloidal silica

Polishing Load: 100 to 200 g/cm$^2$

Figure 4:
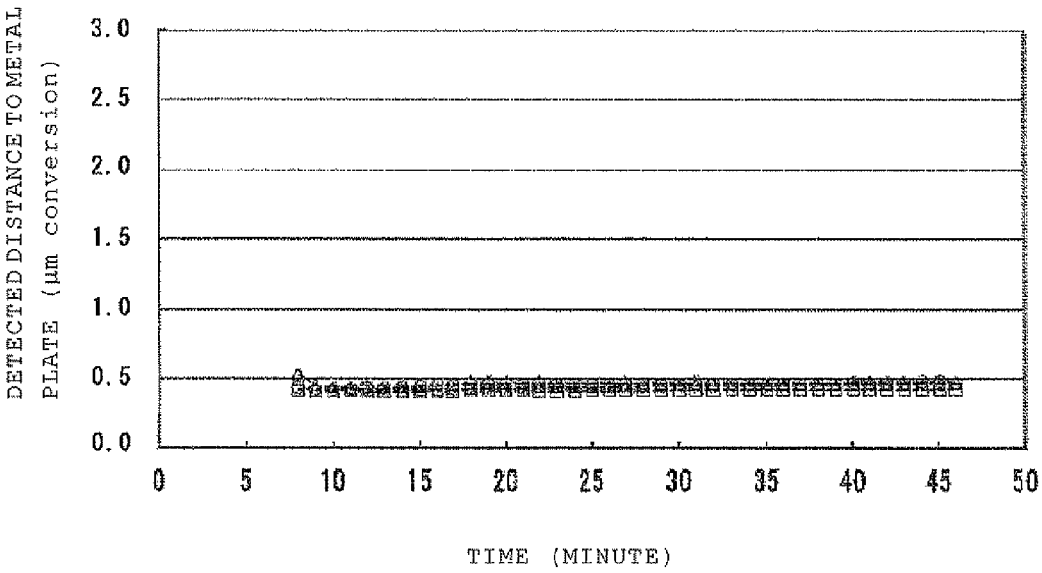
FIG. 4 are diagrams showing the experiment results regarding the amount of sensor holder deformation due to processing heat, in which (A) shows that in the case of using the double-side polishing apparatus of the present invention and (B) shows that in the case of using the conventional double-side polishing apparatus.
Figure 4:
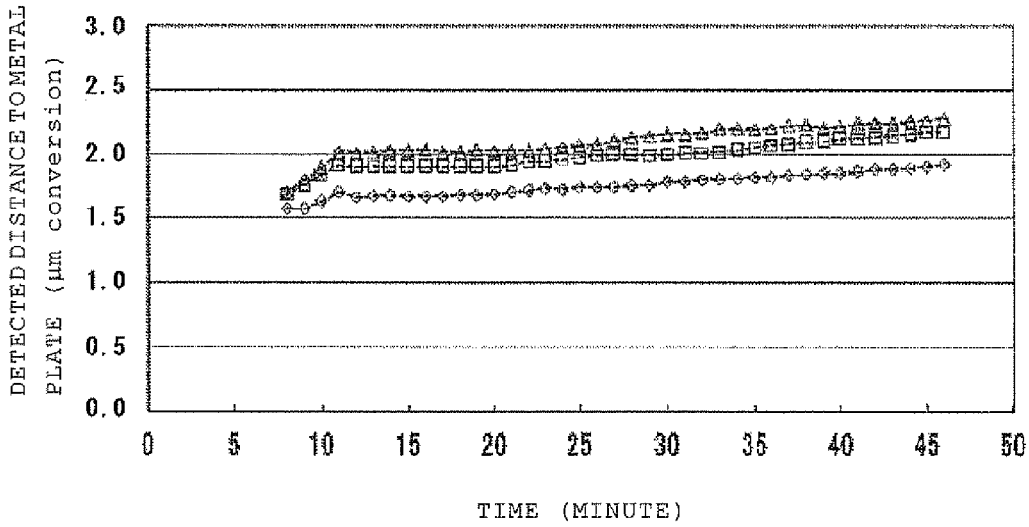

The results are shown in FIGS. 4(A) and (B). FIGS. 4(A) and 4(B) show the three measurement results in the case of using the double-side polishing apparatus of the present invention and in the case of using the conventional double-side polishing apparatus, respectively. The measurement was performed after about 7 minutes from the start-up of the apparatus to its operation stabilization.

As shown in FIGS. 4(A) and (B), when the double-side polishing apparatus of the present invention was used, the variations in the detected distance to the metal plate were significantly reduced in comparison with the case of using the conventional double-side polishing apparatus. In the case of using the conventional apparatus, the difference in the detected distance between before polishing and after polishing was 0.58 μm. On the other hand, in the case of using the inventive apparatus, the difference in the detected distance was 0.06 μm, and the sensor holder deformation was thus significantly improved.

When the wafer W is double-side polished with the double-side polishing apparatus of the present invention as described above, the position deviation of the sensor 6 caused by the expansion and contraction of the sensor holder 7 due to the heat generated during polishing can be surely reduced, and the polishing can be performed while the wafer W thickness is accurately detected by the sensor 6. The difference from the target thickness of the wafer W can be therefore reduced.

EXAMPLE

The present invention will be more specifically described below with reference to Examples and Comparative Example, but the present invention is not limited to these examples.

Examples 1 and 2

With the double-side polishing apparatus of the present invention as shown in FIG. 1, the double-side polishing of a wafer was performed while the wafer thickness was detected by the sensor. The target thickness was set at 775 μm. When the detected thickness by the sensor became the target thickness, the polishing was terminated.

As the sensor, an eddy-current sensor was used. In the Example 1, the sensor was held with a cylindrical quartz sensor holder without any cooling structure. In the Example 2, the sensor was held with the quartz sensor holder having the cooling structure shown in FIG. 2.

Polishing conditions were as follows:

Double-side Polishing Apparatus: a double-side polishing apparatus made by Fujikoshi Machinery Corp.

Wafer: a diameter of 300 mm, P-type, a crystal orientation of <110>

Polishing Pad: single urethane foam pads

Polishing Slurry:NaOH-based colloidal silica

Polishing Load: 100 to 200 g/cm$^2$

After the polishing, the difference between the wafer thickness and the target thickness was evaluated. The flatness of the polished wafer was also evaluated by measuring SFQR (max) with a flatness tester (Nanometoro300TT-A made by Kuroda Manufacture Co., Ltd.).

The results of the difference of the thickness are shown in Table 1. As shown in Table 1, it can be seen that the average difference in each of Example 1 and Example 2 was smaller than that in the later-described Comparative Example. In addition, the average difference in Example 2 in which the sensor holder having the cooling structure was used was approximately halved as compared with that in Example 1.

In Example 1 and Example 2, both results of the standard deviation were also lower than that in Comparative Example. It was thus confirmed that the distribution of the difference was smaller as well as the average difference and variations in the difference were improved.

The results of SFQR(max) are shown in Table 2. As shown in Table 2, it can be seen that both results in Example 1 and Example 2 were smaller than that in the later-described Comparative Example. It can be accordingly understood that the flatness also can be improved by accurately detecting the wafer thickness with the double-side polishing apparatus of the present invention to stop polishing with a proper timing with respect to the target thickness.

As described above, it can be confirmed that the double-side polishing apparatus of the present invention can polish a wafer while the difference from the target wafer thickness is reduced by surely inhibiting the deformation of the sensor holder due to the influence of the heat generated during the polishing of the wafer.

Comparative Example

Figure 3:
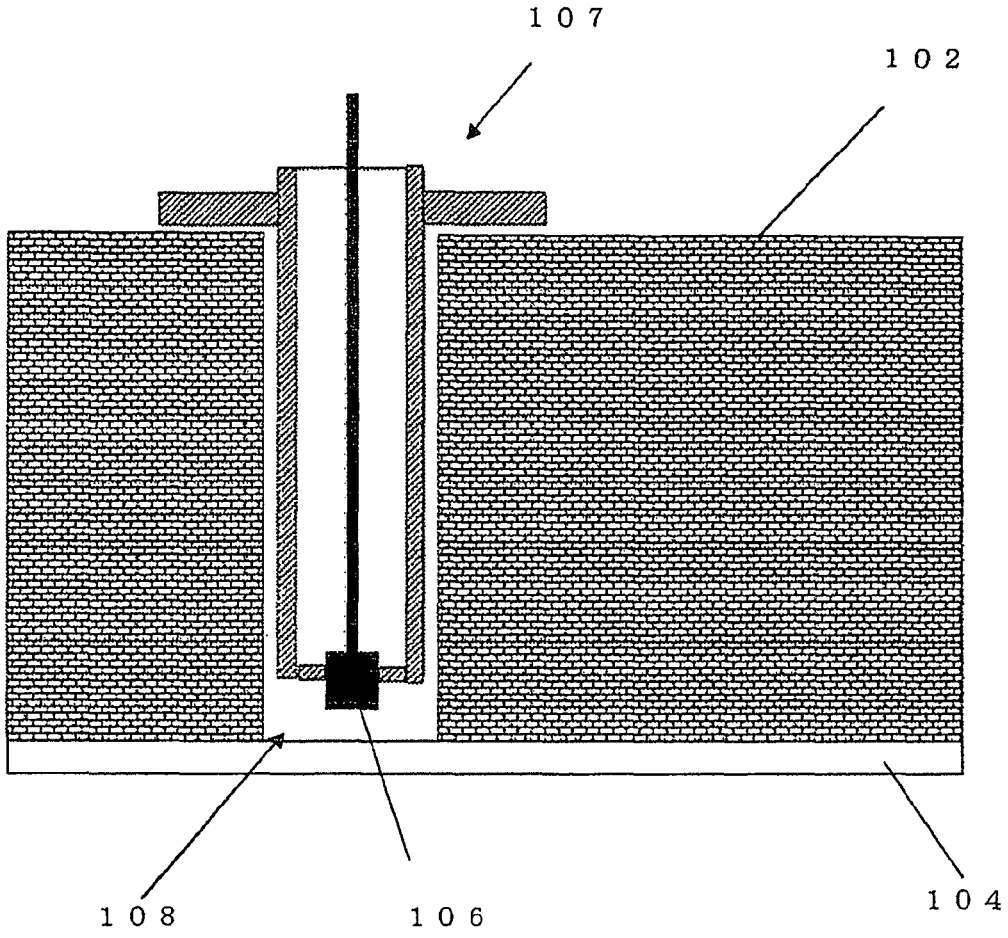
FIG. 3 is a schematic view showing a part of a conventional double-side polishing apparatus.

A wafer was double-side polished as with Example 1 except for using the conventional double-side polishing apparatus having a super invar sensor holder incapable of being cooled as shown in FIG. 3, and the same evaluation was carried out as with Example 1.

From the evaluation result as shown in Table 1, it can be seen that the difference between the wafer thickness and the target thickness was deteriorated in comparison with Example 1 and Example 2.

From the result as shown in Table 2, it can be seen that the result of SFQR(max) was also deteriorated in comparison with Example 1 and Example 2.

It is understood that these were caused by the following: the sensor holder in the conventional double-side polishing apparatus was deformed due to the heat generated during the polishing so that the deviation of the sensor position occurred; and noise was produced in the thickness detection using the sensor.

TABLE 1

| | COMPARATIVE EXAMPLE | EXAMPLE 1 | EXAMPLE 2 |
|---|---|---|---|
| AVERAGE DIFFERENCE (μm) | 0.044 | 0.022 | 0.010 |
| MAXIMUM DIFFERENCE (μm) | 0.91 | 0.51 | 0.45 |
| MINIMUM DIFFERENCE (μm) | −1.00 | −0.55 | −0.33 |
| STANDARD DEVIATION | 0.547 | 0.333 | 0.185 |
| MEASUREMENT NUMBER OF WAFER | 50 | 40 | 40 |

TABLE 2

| | COMPARATIVE EXAMPLE | EXAMPLE 1 | EXAMPLE 2 |
|---|---|---|---|
| AVERAGE SFQR(max) (μm) | 0.0335 | 0.0259 | 0.0244 |
| MAXIMUM SFQR(max) (μm) | 0.048 | 0.034 | 0.033 |
| MINIMUM SFQR(max) (μm) | 0.026 | 0.020 | 0.019 |
| STANDARD DEVIATION | 0.0049 | 0.0032 | 0.0027 |
| MEASUREMENT NUMBER OF WAFER | 50 | 40 | 40 |

It is to be noted that the present invention is not limited to the foregoing embodiment. The embodiment is just an exemplification, and any examples that have substantially the same feature and demonstrate the same functions and effects as those in the technical concept described in claims of the present invention are included in the technical scope of the present invention.

The invention claimed is:

1. A double-side polishing apparatus comprising at least:

upper and lower turn tables to which polishing pads are attached;

a carrier having a holding hole formed therein for holding a wafer between the upper and lower turn tables;

a sensor for detecting a thickness of the wafer during polishing, the sensor being disposed in a through-hole provided at the upper turn table in a direction of an upper-turn-table rotation axis; and a sensor holder for holding the sensor, the sensor holder being accommodated in the through-hole of the upper turn table, wherein a material of the sensor holder is quartz.

2. The double-side polishing apparatus according to claim 1, wherein the quartz has a linear expansion coefficient of $5.4\times10^{-7}$/K or less.

3. The double-side polishing apparatus according to claim 1, wherein the sensor holder is capable of being cooled using water.

4. The double-side polishing apparatus according to claim 2, wherein the sensor holder is capable of being cooled using water.

5. The double-side polishing apparatus according to claim 1, wherein the sensor holder has a cylindrical body accommodated in the through-hole of the upper turn table, holds the sensor at a position of a lowermost end of the cylindrical body, and has an inlet for introducing a coolant into the interior of the cylindrical body and an outlet for discharging the coolant.

6. The double-side polishing apparatus according to claim 2, wherein the sensor holder has a cylindrical body accommodated in the through-hole of the upper turn table, holds the sensor at a position of a lowermost end of the cylindrical body, and has an inlet for introducing a coolant into the interior of the cylindrical body and an outlet for discharging the coolant.

7. The double-side polishing apparatus according to claim 3, wherein the sensor holder has a cylindrical body accommodated in the through-hole of the upper turn table, holds the sensor at a position of a lowermost end of the cylindrical body, and has an inlet for introducing a coolant into the interior of the cylindrical body and an outlet for discharging the coolant.

8. The double-side polishing apparatus according to claim 2, wherein the sensor holder has a cylindrical body accommodated in the through-hole of the upper turn table, holds the sensor at a position of a lowermost end of the cylindrical body, and has an inlet for introducing a coolant into the interior of the cylindrical body and an outlet for discharging the coolant.

* * * * *